US005540360A

United States Patent [19]

Foster et al.

[11] Patent Number: 5,540,360

[45] Date of Patent: Jul. 30, 1996

[54] INVERTIBLE TRIGGER SPRAYER ASSEMBLY

[75] Inventors: Donald D. Foster, St. Charles; Philip L. Nelson, Ellisville, both of Mo.

[73] Assignee: Contico International, Inc., St. Louis, Mo.

[21] Appl. No.: 242,281

[22] Filed: May 13, 1994

[51] Int. Cl.[6] ..... B67D 5/42

[52] U.S. Cl. ..... 222/376; 222/383.1

[58] Field of Search ..... 222/321.1–321.9, 222/376, 383.1–383.3, 385, 481, 481.5, 482

[56] References Cited

U.S. PATENT DOCUMENTS

| | | | |
|---|---|---|---|
| 1,484,920 | 2/1924 | Wolfe | 222/376 X |
| 1,735,784 | 11/1929 | Olson | 222/376 X |
| 2,812,117 | 11/1957 | Butkus et al. | 222/481 X |
| 2,851,201 | 9/1958 | Poitras et al. | 222/481 |
| 3,315,693 | 4/1967 | Braun | 137/43 |
| 3,379,136 | 4/1968 | Corsette | 222/321 X |
| 4,174,790 | 10/1979 | Nozawa et al. | 222/321 |
| 4,274,560 | 6/1981 | Cater | 222/321 |
| 4,277,001 | 7/1981 | Nozawa | 222/321 |
| 4,284,211 | 8/1981 | Meshberg | 222/182 |
| 4,726,386 | 2/1988 | Schultz | 132/79 |
| 4,735,347 | 4/1988 | Schultz et al. | 222/321 |
| 4,775,079 | 10/1988 | Grothoff | 222/321 |
| 4,895,279 | 1/1990 | Schultz | 222/321 |
| 4,942,985 | 7/1990 | Schultz | 222/376 |
| 4,991,746 | 2/1991 | Schultz | 222/321 |
| 5,119,974 | 6/1992 | Mann | 222/376 |
| 5,125,543 | 6/1992 | Rohrabacher et al. | 222/211 |
| 5,183,186 | 2/1993 | Delaney, Jr. | 222/211 |
| 5,192,007 | 3/1993 | Blomquist | 222/376 |
| 5,195,664 | 3/1993 | Rhea | 222/464 |
| 5,222,636 | 6/1993 | Meuresch | 222/321 |
| 5,277,559 | 1/1994 | Schultz | 417/540 |
| 5,341,967 | 8/1994 | Silvenis | 222/376 |

FOREIGN PATENT DOCUMENTS

| | | | |
|---|---|---|---|
| 2632662 | 1/1977 | Germany . | |
| 3929064 | 1/1991 | Germany | 222/376 |
| 287342 | 3/1953 | Switzerland | 222/376 |

*Primary Examiner*—Andres Kashnikow
*Assistant Examiner*—Kenneth Bomberg
*Attorney, Agent, or Firm*—Howell & Haferkamp, L.C.

[57] ABSTRACT

A sprayer assembly operable in an upright and an inverted position for dispensing liquid from a container. The assembly has a housing having an outlet passage, an outlet orifice through which liquid is dispensed, a pump element having a pump chamber within said housing, a primary passage for delivering liquid from the container to the pump chamber with the sprayer in the upright position, and a secondary passage for delivering liquid from the container to the pump chamber with the sprayer in the inverted position. Valves within the housing allow liquid to flow through the primary passage and into the pump chamber and inhibit fluid flow through the secondary passage into the pump chamber upon a reduction of pump chamber pressure with the sprayer in the upright position; and allow liquid to flow through the secondary passage and into the pump chamber and inhibit fluid flow through the primary passage into the pump chamber upon a reduction of pump chamber pressure with the sprayer in the inverted position.

24 Claims, 2 Drawing Sheets

INVERTIBLE TRIGGER SPRAYER ASSEMBLY

BACKGROUND OF THE INVENTION

This invention is directed to the field of trigger dispensers, also known as trigger sprayers. The invention is particularly directed to a trigger sprayer having unique features enabling it to be used in both the upright and inverted positions.

Generally, a trigger sprayer is a relatively low cost pump device having a trigger. It may be grasped in the hand to pump liquid from a container and through a nozzle at the front of the sprayer in response to actuation of the trigger. The sprayer is connected to the container by a closure, and a dip tube or other passage provides fluid communication between the container and a pump element within the sprayer.

The pump element has an interior volume which decreases and increases in response to pulling and releasing the trigger, respectively. Check valves are positioned at the entrance and exit of the pump element to assure that fluid only flows in the proper direction through the sprayer. For instance, when the trigger is pulled, the volume of the pump element decreases and the liquid within the element is expelled past the exit check valve, through a barrel and out the nozzle orifice. At the same time, the entrance check valve is closed thereby inhibiting flow from the pump element to the container. Likewise, when the trigger is released, the volume of the pump element increases and liquid is drawn from the container, through the dip tube, past the entrance check valve and into the pump element. During this stroke the exit check valve is closed to inhibit flow from the barrel to the pump element.

There are numerous features which have become well-known in the trigger sprayer industry in addition to the basic configuration outlined above. For instance, some non-invertible sprayers include sealing means to prevent liquid from leaking from the nozzle orifices during shipment or non-use. Another feature of many non-invertible trigger sprayers is a vent system which prevents a vacuum from forming within the container as liquid is withdrawn. However, most typical trigger sprayers are not operable in the inverted position. If inverted operation is attempted, liquid is only dispensed until the dip tube is empty because the end of the dip tube is above the surface of the liquid in the inverted position. In addition, depending on the vent system used, liquid will drain through the vent with the sprayer inverted.

Several prior art trigger sprayers have been developed which permit a trigger sprayer dispenser to be used in inverted operation. For example, Yoshino German Patent 26 32 662 discloses a trigger dispenser having a housing extension which protrudes into the container. Two dip tubes extend from the housing extension; one tube extends to the bottom of the container, and the other extends to the top of the container. Ball valves are located at the junction of the extension and dip tubes. The ball valves shut off flow from whichever dip tube is oriented upward relative to the junction. However, the Yoshino patent does not provide for extended operation in either the upright or inverted position since a vent system is not included. Since the Yoshino sprayer does not have a vent system, a vacuum will develop in the container which will prevent liquid from being dispensed. Thus, air must periodically be introduced into the container thereby causing the user some inconvenience. In addition, the Yoshino housing extension and dip tubes are more bulky than a typical trigger dispenser. The size of the housing extension must be taken into account when designing a sprayer since the extension will not fit into a small-mouth container. Likewise, the assembly and disassembly of the trigger sprayer from the container are somewhat obstructed by the bulk of the extension and dip tubes.

Mann U.S. Pat. No. 5,119,974 discloses another invertible trigger sprayer apparatus. The Mann apparatus is a fairly typical trigger sprayer except that a tee junction is introduced partially down the dip tube, and a second dip tube is mounted on the tee so that the dip tube extends upward from the tee to the top of the container. Ball valves are positioned near the open end of each of the dip tubes to block flow in whichever dip tube is oriented upward. Although having a somewhat different configuration, the Mann design has the same shortcomings as the Yoshino design.

Rhea U.S. Pat. No. 5,195,664 discloses a trigger sprayer dispenser with a flexible dip tube extension which is weighted so that the end of the dip tube extends downward into the liquid no matter what the orientation of the container. However, like Yoshino and Mann, Rhea does not address the problems associated with the vent system, and requires a weighted head to be located within the container.

The patent of Blomquist U.S. Pat. No. 5,192,007 discloses another trigger sprayer which also may be used in the inverted position. Blomquist uses a traditional dip tube mounted to an adaptor plate connected to a fairly standard trigger sprayer. The adaptor plate incorporates two check valves. During inverted operation, one of the check valves closes to prevent liquid in the container from flowing out the vent passage. The other check valve opens when the pump element pressure decreases and liquid is drawn from the container, through the passage and into the pump element. However, liquid is also drawn from the dip tube during inverted operation thereby lowering the level of liquid in the dip tube. Thus, when the container is returned to the upright position, air is entrapped in the dip tube. Several trigger strokes are required to expel the air, during which liquid is either not dispensed or dispensed in a less than optimal pattern.

The present invention overcomes the disadvantages of the prior art trigger sprayers and provides a unique trigger sprayer which is operable in both the upright and inverted positions to produce a high quality spray without entrapping air and without leakage of liquid from the vent passage.

SUMMARY OF THE INVENTION

In accordance with the trigger sprayer assembly of the present invention, liquid from the bottom of the container is drawn through a primary passage when the trigger sprayer assembly is operated in the upright position, and liquid from the top of the container is drawn through a secondary passage when the trigger sprayer is operated in the inverted position.

The primary and secondary passages have valves located therein. In the upright position, on the suction stroke of the trigger, these valves operate to allow the passage of liquid through the primary passage and into the pump chamber and to inhibit the passage of liquid through the secondary passage. On the compression stroke, the valves operate to allow the passage of liquid from the pump chamber to the outlet orifice. In the inverted position on the suction stroke of the trigger, the valves operate to allow the passage of liquid through the secondary passage and into the pump chamber and to inhibit the passage of liquid through the primary passage. On the compression stroke the valves operate to allow the passage of liquid only from the pump chamber to the outlet orifice.

Therefore, with the passage and valving arrangement utilized with the present invention, the sprayer will operate in either the upright or inverted position to produce a high quality spray without drawing air into the pump chamber. Moreover, the valving of the present invention is incorporated within the sprayer body or housing and there is no cumbersome valve structure extending into the container. In addition, the present invention incorporates a check valve for closing the vent passage when the sprayer is inverted to prevent liquid leaking therefrom.

DETAILED DESCRIPTION OF THE PREFERRED EMBODIMENT

Figure 1:
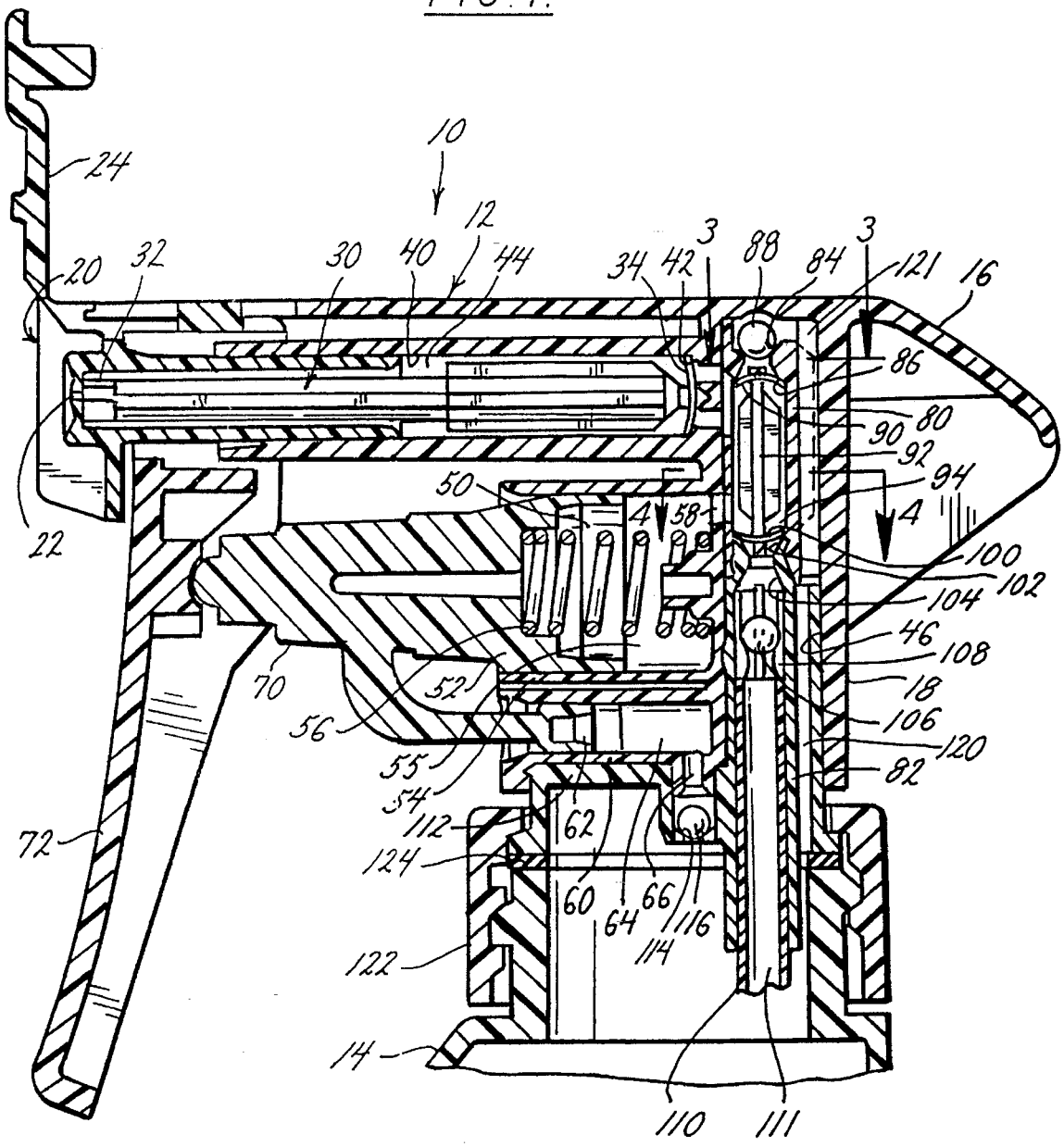
FIG. 1 is a section view of the trigger sprayer of the present invention shown in the upright position.
Figure 2:
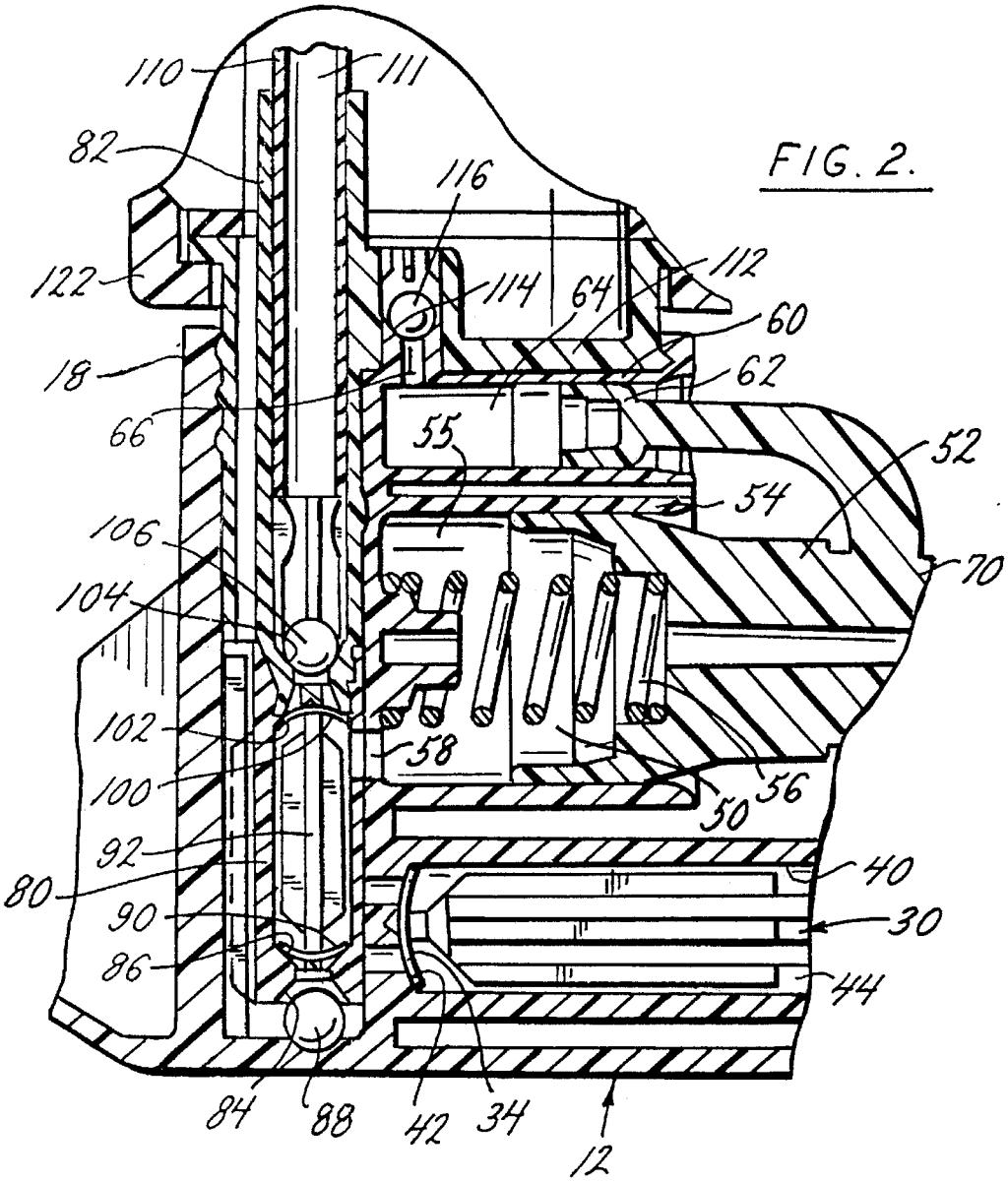
FIG. 2 is a partial, section view of the trigger sprayer of the present invention shown in the inverted position.
Figure 3:
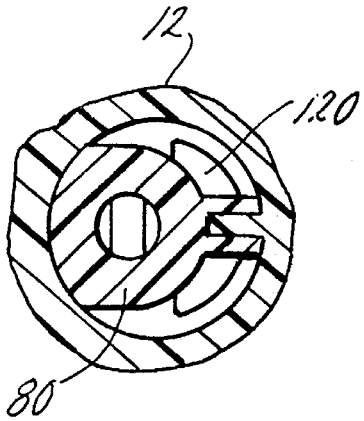
FIG. 3 is a partial, section view of the trigger sprayer taken in the plane of line 3—3 of FIG. 1 showing details of the secondary passage and ball valve seat.
Figure 4:
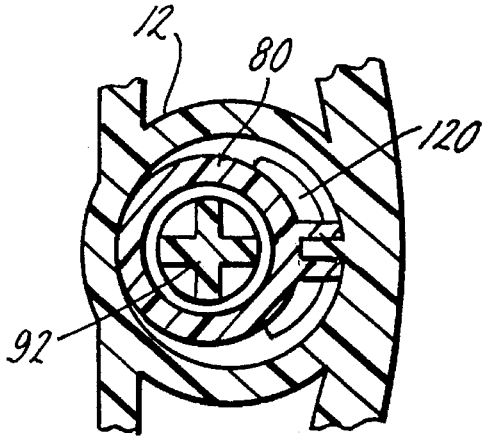
FIG. 4 is a partial, section view of the trigger sprayer taken in the plane of line 4—4 of FIG. 1 showing details of the shuttle and secondary passage.

FIGS. 1 and 2 show a trigger sprayer assembly 10 of the present invention. The assembly 10 has a housing 12 connected to a container 14. The housing 12 is comprised of a pump chamber housing and a valve housing 18. A nozzle assembly 20 connects to the forward end of the pump chamber housing 16. The nozzle assembly 20 has an orifice 22 through which the liquid is dispensed. The nozzle assembly 20 also incorporates hinged sealing means 24 to prevent leakage from the orifice 22 during shipment and storage.

Behind the nozzle orifice 22 is a spinner assembly 30 which includes a spinner head 32 on the forward end and a check valve body 34 at the rearward end. The spinner assembly 30 is retained within a barrel 40 formed in the pump chamber housing 16. A primary check valve seat 42 is located at the rearward end of the barrel 40 and the primary check valve body 34 is normally biased toward the check valve seat 42 to form the primary check valve. In the preferred embodiment, the primary check valve is a disk valve. The volume created between the spinner assembly 30 and the barrel 40 forms the outlet passage 44 of the trigger sprayer.

Immediately behind the check valve seat 42 is a valve housing receptacle 46 which extends vertically downward toward the container. This receptacle receives the valve housing 18 to be described. A pump element 50 is positioned below the barrel 40 and is comprised of a pump piston 52 and pump cylinder 54 having a pump chamber 55 therein. A return spring 56 biases the pump piston 52 toward the extended position shown in FIG. 1. An opening 58 is provided at the rear of the pump cylinder 54 to permit liquid to enter and exit the pump chamber 55. A vent cylinder 60 is located below the pump cylinder 54. A vent piston 62 slides within the vent cylinder 60 and defines with the vent cylinder 60 a vent chamber 64. Both the pump cylinder 54 and vent cylinder 60 are integrally formed with the pump chamber housing 16. At the rearward end of the vent cylinder 60 along the bottom side is a vent passage 66. The vent piston 62 and pump piston 52 are joined to a plunger 70 so that they simultaneously actuate with the plunger. A trigger 72 is pivotally mounted to the pump chamber housing and engages the forward end of the plunger 70 to actuate the pump and vent pistons 52, 62 with operation of the trigger.

The valve housing 18 is received within the valve housing receptacle 46 and is comprised of upper and lower valve housings 80, 82. The upper valve housing 80 is positioned within the valve housing receptacle 46 behind the outlet passage 44. Two valve seats 84, 86 are located at the top of the upper valve housing 80. Above the upper valve seat 84 of this pair is an orientation-sensitive valve body 88 which is a ball valve body in this preferred embodiment. A check valve body 90 is below and biased against the lower valve seat 86. This check valve body is a disk valve in this preferred embodiment.

The check valve body 90 is attached to a shuttle 92 which extends downward in an antechamber 94 formed in the upper valve housing 80. This antechamber 94 communicates the pump cylinder opening 58 with the outlet passage 44. On the lower end of the shuttle 92 is another check valve body 100 which seals against another valve seat 102 formed in the lower valve housing 82. This check valve body 100 is also a disk valve in this preferred embodiment. Below the valve seat 102 is another valve seat 104 which accepts another orientation-sensitive valve body 106. This orientation-sensitive valve body 106 is also a ball valve body in this preferred embodiment. Keepers 108 protrude from the lower valve housing 82 to retain the lower orientation-sensitive valve body 106. Below the keepers 108 is a dip tube 110 which extends to the bottom of the container 14 to draw liquid therethrough in the upright position. Together with the lower check valve 102 and the lower orientation-sensitive valve 104, the dip tube 110 forms a primary passage 111.

The lower side of the lower valve housing 82 has a plate 112 which segregates the housing 12 from the container 14. The plate 112 has a valve seat 114 for retaining and sealing an orientation-sensitive valve body 116 in line with the vent passage 66. As with the other orientation-sensitive valve bodies, this valve body 116 is a ball valve body in this preferred embodiment.

A crescent-shaped passage 120 extends from the top of the container 14 through the lower valve housing 82 and between the upper valve housing 80 and valve housing receptacle 46. This passage 120 is to draw liquid from the container 14 in the inverted position. Together with the upper check valve 86 and the upper orientation-sensitive valve 84, the crescent-shaped passage 120 forms a secondary passage 121.

A closure 122 is used to connect the trigger sprayer to the container 14. A gasket 124 is included between the sprayer and container to prevent leakage.

In operation, when the trigger is pulled on the pressure stroke, the pump chamber volume is decreased thereby expelling liquid from the pump chamber 55, and into the antechamber 94. The check valves 86, 100 prevent liquid from backflowing into the primary and secondary passages 111, 121. Thus, the liquid is pushed through the primary valve 34 and outlet passage 44 and out the nozzle orifice 22. This operation is the same whether the sprayer is in the inverted or upright position. However, the operation differs during the suction stroke depending upon whether the sprayer is upright or inverted.

In upright operation as shown in FIG. 1, the upper, orientation-sensitive valve 88 is closed so that the secondary passage 121 is blocked and the lower orientation-sensitive valve 106 is open. Thus, when the trigger 72 is released and the pump chamber volume increases, liquid is drawn from the container, through the primary passage 111, past the lower orientation-sensitive valve 106, through the lower check valve 100, and into the pump chamber 55. The upper orientation-sensitive valve 88, being closed, prevents liquid or air from being drawn from the container, through the secondary passage 121 and into the pump chamber 55. During inverted operation as shown in FIG. 2, the lower, orientation-sensitive valve 106 is closed so that the primary passage 111 is blocked, and the upper orientation-sensitive valve 88 is open. Thus, as the pump chamber volume is increased, liquid is drawn from the container, through the secondary passage 121, past the upper orientation-sensitive valve 88, through the upper check valve 90, and into the pump chamber 55. The lower orientation-sensitive valve 106, being closed, prevents liquid from being drawn from the primary passage 111 into the pump chamber 55. Therefore, whether operated in the upright or the inverted position, only liquid is drawn into the pump chamber 55 on the suction stroke.

When the trigger 72 is pulled, the vent piston 62 moves rearward inside the vent cylinder 60 to expose the vent passage 66 to ambient. During inverted operation, this vent passage 66 is blocked by the orientation-sensitive sensitive valve 116 to prevent liquid from leaking out the vent passage 66.

The housing of the preferred embodiment is molded in the three pieces 16, 80, 82 previously described. Each housing piece is integrally formed of a suitable plastic material such as polypropylene. Other components of the assembly, particularly those that perform a sealing function, may be molded of a suitable plastic material such as polyethylene. The shuttle 92 and disc valves 90, 100 are integrally formed as a one-piece valve unit of a suitable plastic material. The ball valve bodies are preferably metallic although other suitable materials can be used.

While the preferred embodiment has been described by reference to specific embodiments, it should be understood that modifications and variations of the invention may be constructed without departing from the scope of the invention defined in the following claims.

What is claimed is:

1. A sprayer assembly for dispensing liquid from a container, said assembly being operable in an upright and an inverted position, said assembly comprising:

a housing having an outlet passage;

an outlet orifice through which liquid is dispensed;

a pump element having a pump chamber within said housing, said pump element for pumping liquid from said container and through said orifice;

a primary passage for delivering liquid from the container to the pump chamber with the sprayer assembly in the upright position;

a secondary passage for delivering liquid from the container to the pump chamber with the sprayer assembly in the inverted position; and valves positioned within said housing and external to the container when the housing is connected to the container for allowing flow of liquid through said primary passage and into said pump chamber and inhibiting flow of fluid through said secondary passage into said pump chamber upon a reduction of pump chamber pressure with the sprayer assembly in the upright position; and for allowing flow of liquid through said secondary passage and into said pump chamber and inhibiting flow of fluid through said primary passage into said pump chamber upon a reduction of pump chamber pressure with the sprayer assembly in the inverted position.

2. The sprayer assembly of claim 1 wherein said valves further permit flow of liquid from said pump chamber and through said outlet passage and inhibit flow of liquid through said primary and secondary passages upon an increase in pump chamber pressure in the upright and inverted positions.

3. The sprayer assembly of claim 2 wherein said valves comprise orientation-sensitive valves and check valves.

4. The sprayer assembly of claim 3 wherein said orientation-sensitive valves comprise ball valves.

5. The sprayer assembly of claim 3 wherein said check valves comprise disk valves.

6. The sprayer assembly of claim 1 further comprising:

a vent within said sprayer assembly communicating the container with ambient when the sprayer assembly is in the upright position; and a valve for inhibiting flow of liquid from said container through said vent when the sprayer assembly is in the inverted position.

7. The sprayer assembly of claim 6 wherein said vent valve comprises an orientation-sensitive valve.

8. The sprayer assembly of claim 7 wherein said orientation-sensitive vent valve comprises a ball valve.

9. A sprayer assembly for dispensing liquid from a container, said assembly being operable in an upright and an inverted position, said assembly comprising:

a housing having an outlet passage;

a pump element having a pump chamber within said housing, said pump element for pumping liquid from said container and through said outlet passage;

a primary passage for delivering liquid from the container to the pump chamber with the sprayer assembly in the upright position;

a secondary passage for delivering liquid from the container to the pump chamber with the sprayer assembly in the inverted position;

a first valve assembly positioned within the primary passage for inhibiting flow of liquid through said primary passage upon a change in pump element pressure when the sprayer assembly is in the inverted position and upon an increase in pump element pressure when the sprayer assembly is in the upright position, said first valve assembly permitting flow of liquid through said primary passage upon a decrease in pump element pressure when the sprayer assembly is in the upright position; and a second valve assembly positioned within the secondary passage for inhibiting flow of liquid through said secondary passage upon a change in pump element pressure when the sprayer assembly is in the upright position and upon an increase in pump element pressure when the sprayer assembly is in the inverted position, said second valve assembly permitting flow of liquid through said secondary passage upon a decrease in pump element pressure when the sprayer assembly is in the inverted position said first and second valve assemblies positioned within said housing and external to the container when the housing is connected to the container.

10. The sprayer assembly of claim 9 wherein said first valve assembly comprises an orientation-sensitive valve and a check valve.

11. The sprayer assembly of claim 10 wherein said orientation-sensitive valve comprises a ball valve.

12. The sprayer assembly of claim 10 wherein said check valve comprises a disk valve.

13. The sprayer assembly of claim 9 wherein said second valve assembly comprises an orientation-sensitive valve and a check valve.

14. The sprayer assembly of claim 13 wherein said orientation-sensitive valve comprises a ball valve.

15. The sprayer assembly of claim 13 wherein said check valve comprises a disk valve.

16. The sprayer assembly of claim 9 further comprising:

a vent within said sprayer assembly for communicating the container with ambient when the sprayer assembly is in the upright position; and a valve for inhibiting flow of liquid from said container through said vent when the sprayer assembly is in the inverted position.

17. The sprayer assembly of claim 16 wherein said vent valve comprises an orientation-sensitive valve.

18. The sprayer assembly of claim 17 wherein said orientation-sensitive valve comprises a ball valve.

19. A sprayer assembly for dispensing liquid from a container, said assembly being operable in the upright and the inverted positions, said assembly comprising:

a housing having an outlet passage;

a pump element having a pump chamber within said housing, said pump element for pumping liquid from said container and through said outlet passage;

an antechamber within said housing and positioned rearward of said pump element and said outlet passage;

a primary passage for delivering liquid from the container to the antechamber with the sprayer assembly in the upright position, said primary passage being generally vertically oriented;

a secondary passage for delivering liquid from the container to the antechamber with the sprayer assembly in the inverted position, said secondary passage being generally vertically oriented within said housing;

a first orientation-sensitive valve positioned within the primary passage for inhibiting flow of liquid through said primary passage when the sprayer assembly is in the inverted position;

a first check valve positioned within the primary passage for inhibiting flow of liquid through said primary passage upon an increase in pump element pressure;

a second orientation-sensitive valve positioned within the secondary passage for inhibiting flow of liquid through said secondary passage when the sprayer assembly is in the upright position;

a second check valve positioned within the secondary passage for inhibiting flow of liquid through said secondary passage upon an increase in pump element pressure; and a third check valve positioned with the outlet passage for inhibiting flow of liquid through said outlet passage upon a decrease in pump element pressure.

20. The sprayer assembly of claim 19 further comprising:

a vent within said sprayer assembly for communicating the container with ambient when the sprayer assembly is in the upright position; and a valve for inhibiting flow of liquid from said container through said vent when the assembly is in the inverted position.

21. A sprayer for attachment to a liquid container, the sprayer comprising:

a sprayer housing having an outlet passage;

a connector attached to the housing for connecting the sprayer housing to the liquid container;

a pump for pumping liquid from the liquid container and through the outlet passage, the pump including a pump chamber;

a primary passage for delivering liquid from the liquid container to the pump chamber with the sprayer in an upright position;

a secondary passage for delivering liquid from the liquid container to the pump chamber with the sprayer in an inverted position;

a first orientation-sensitive valve positioned within the housing for inhibiting flow of liquid through the primary passage when the sprayer is in the inverted position;

a first check valve positioned within the housing and biased toward a normally closed position for inhibiting flow of liquid through the primary passage upon an increase in pressure in the pump chamber;

a second orientation-sensitive valve positioned within the housing for inhibiting flow of liquid through the secondary passage when the sprayer is in the upright position; and a second check valve positioned within the housing and biased toward a normally closed position for inhibiting flow of liquid through the secondary passage upon an increase in pressure in the pump chamber.

22. The sprayer of claim 21 wherein the first and second orientation-sensitive valves and the first and second check valves are positioned outside the liquid container when the sprayer is attached to the liquid container.

23. The sprayer of claim 21 wherein the first check valve is integrally formed with the second check valve.

24. The sprayer of claim 21 wherein a portion of the secondary passage extends generally parallel to a portion of the primary passage.

* * * * *